US009193195B1

(12) United States Patent
Kondo

(10) Patent No.: US 9,193,195 B1
(45) Date of Patent: Nov. 24, 2015

(54) PRINTER

(71) Applicant: BROTHER KOGYO KABUSHIKI KAISHA, Nagoya-shi, Aichi-ken (JP)

(72) Inventor: Kazuyuki Kondo, Kuwana (JP)

(73) Assignee: BROTHER KOGYO KABUSHIKI KAISHA, Nagoya-Shi (JP)

( * ) Notice: Subject to any disclaimer, the term of this patent is extended or adjusted under 35 U.S.C. 154(b) by 0 days.

(21) Appl. No.: 14/735,621

(22) Filed: Jun. 10, 2015

(30) Foreign Application Priority Data

Jun. 11, 2014 (JP) ..... 2014-120250

(51) Int. Cl.
*B41J 23/00* (2006.01)
*B41J 25/00* (2006.01)
*B41J 2/165* (2006.01)

(52) U.S. Cl.
CPC ..... *B41J 25/001* (2013.01); *B41J 2/16505* (2013.01)

(58) Field of Classification Search
CPC ..... B41J 2/165; B41J 2/16505; B41J 11/005; B41J 11/008; B41J 11/20; B41J 19/005; B41J 25/001; B41J 25/308; B41J 25/3088; B41J 25/3082
USPC ..... 347/21, 22, 29, 37; 400/55, 58, 59
See application file for complete search history.

(56) References Cited

U.S. PATENT DOCUMENTS 5,946,009 A * 8/1999 Youn ..... B41J 2/16547 347/22
2001/0021330 A1* 9/2001 Kishida ..... B41J 23/025 400/55
2004/0041880 A1* 3/2004 Ikeda ..... B41J 3/4071 347/37
2012/0044310 A1* 2/2012 Yajima ..... B41J 2/1752 347/104

FOREIGN PATENT DOCUMENTS

JP H07-40533 A 2/1995

* cited by examiner

*Primary Examiner* — Stephen Meier
*Assistant Examiner* — Sharon A Polk
(74) *Attorney, Agent, or Firm* — Fox Rothschild LLP

(57) ABSTRACT

A printer includes a feeding portion for feeding a print medium in a first direction, an ejection portion for ejecting liquid, a carriage, a guide shaft, a rail member, a first pressing portion, an eccentric member, a regulating portion, and a prohibition portion. The carriage includes the ejection portion and reciprocates in a second direction which is orthogonal to the first direction. The guide shaft extends in the second direction and supports the carriage. The rail member is disposed facing the guide shaft. The first pressing portion presses a first surface of the rail member. The eccentric member has a rotating shaft portion and an eccentric shaft portion that is eccentric with respect to the rotating shaft portion. The regulating portion comes into contact with a second surface of the rail member, and regulates movement of the carriage. The prohibition portion prohibits rotation of the rotating shaft portion.

6 Claims, 14 Drawing Sheets

PRINTER

CROSS-REFERENCE TO RELATED APPLICATION

This application claims priority to Japanese Patent Application No. 2014-120250 filed Jun. 11, 2014, the content of which is hereby incorporated herein by reference.

BACKGROUND

The present disclosure relates to a printer that performs printing by ejecting liquid onto a print medium.

In related art, an inkjet printer is known which performs printing by ejecting ink from nozzles onto a print medium, and which can inhibit printing failure. Specifically, an inkjet printer is known that inhibits evaporation of ink by causing a cap, which is used to seal nozzle openings, to come into contact with an ink ejection surface when printing is not being performed, and thus inhibits printing failure due to an increase in ink viscosity or the like. There are cases in which an inkjet head is mounted on a carriage that is supported by a guide shaft and a guide plate (rail). The guide shaft is provided in a direction that is orthogonal to a movement direction of the print medium. The guide plate is provided in parallel with the guide shaft. For example, an inkjet printer that includes a gap adjustment device is disclosed. In this inkjet printer, a cam surface of an eccentric cam that is rotatably provided on the carriage is caused to come into contact with a rail, and a distance between the ink ejection surface and a printing surface of the print medium is adjusted.

SUMMARY

When, for example, the number of components that are attached on the rail side of the carriage is larger than the number of components that are attached on the shaft side of the carriage, a tolerance difference is likely to occur on the rail side of the carriage. In the above-described structure, a difference is likely to occur between a distance between an ejection portion and a cap that is on a side close to the rail side of the ejection portion and a distance between the ejection portion and a cap that is on a side close to the shaft side of the ejection portion. When a gap is generated between the cap and the ejection portion, the cap cannot sufficiently cover the ejection portion and sealing performance between the cap and the ejection portion cannot be secured. As a result, it is likely to be affected by the external environment.

It is an object of the present disclosure to provide a printer that can secure sealing performance between an ejection portion and a cap.

A printer according to the present disclosure includes a feeding portion, an ejection portion, a carriage, a guide shaft, a rail member, a cap, a first pressing portion, an eccentric member, a regulating portion, and a prohibition portion. The feeding portion is configured to feed a print medium in a first direction. The ejection portion is configured to eject liquid toward the print medium. The ejection portion is mounted on the carriage. The carriage is configured to reciprocate in a second direction. The second direction is a direction that is orthogonal to the first direction. The guide shaft extends in the second direction and supports a first end portion of the carriage in the first direction. The rail member extends in the second direction and is disposed facing the guide shaft. The cap covers the ejection portion from a first side. The first side is a direction toward which the ejection portion ejects the liquid. The first pressing portion is provided on a second end portion of the carriage and presses a first surface, which is a surface on the first side of the rail member. The second end portion of the carriage is an end portion on an opposite side to the first end portion of the carriage in the first direction. The eccentric member has a rotating shaft portion and an eccentric shaft portion. The rotating shaft portion is axially supported by the second end portion of the carriage and extends in the first direction. The eccentric shaft portion is eccentric with respect to the rotating shaft portion. The regulating portion is supported by the eccentric shaft portion and is disposed on a second side of the first pressing portion such that the regulating portion faces the first pressing portion with the rail member interposed between the regulating portion and the first pressing portion. The regulating portion comes into contact with a second surface of the rail member and regulates movement of the carriage to the first side. The second side of the first pressing portion is an opposite side to the first side of the first pressing portion. The second surface of the rail member is a surface on the second side of the rail member. The prohibition portion fixes the rotating shaft portion and prohibits rotation of the rotating shaft portion.

BRIEF DESCRIPTION OF THE DRAWINGS

Embodiments will be described below in detail with reference to the accompanying drawings in which.

DETAILED DESCRIPTION

An embodiment of the present disclosure will be explained with reference to the drawings. The drawings are used to explain technological features that can be adopted by the present disclosure, and are not intended to limit the content. First, a schematic structure of a printer 1 will be explained with reference to FIG. 1 and FIG. 2. The upper side, the lower side, the lower left side, the upper right side, the lower right side and the upper left side of FIG. 1 respectively correspond to the upper side, the lower side, the front side, the rear side, the right side and the left side of the printer 1. An illustration of purge units 30 and 30 (refer to FIG. 5), which will be described later, is omitted in FIG. 1 to FIG. 4.

Figure 1:
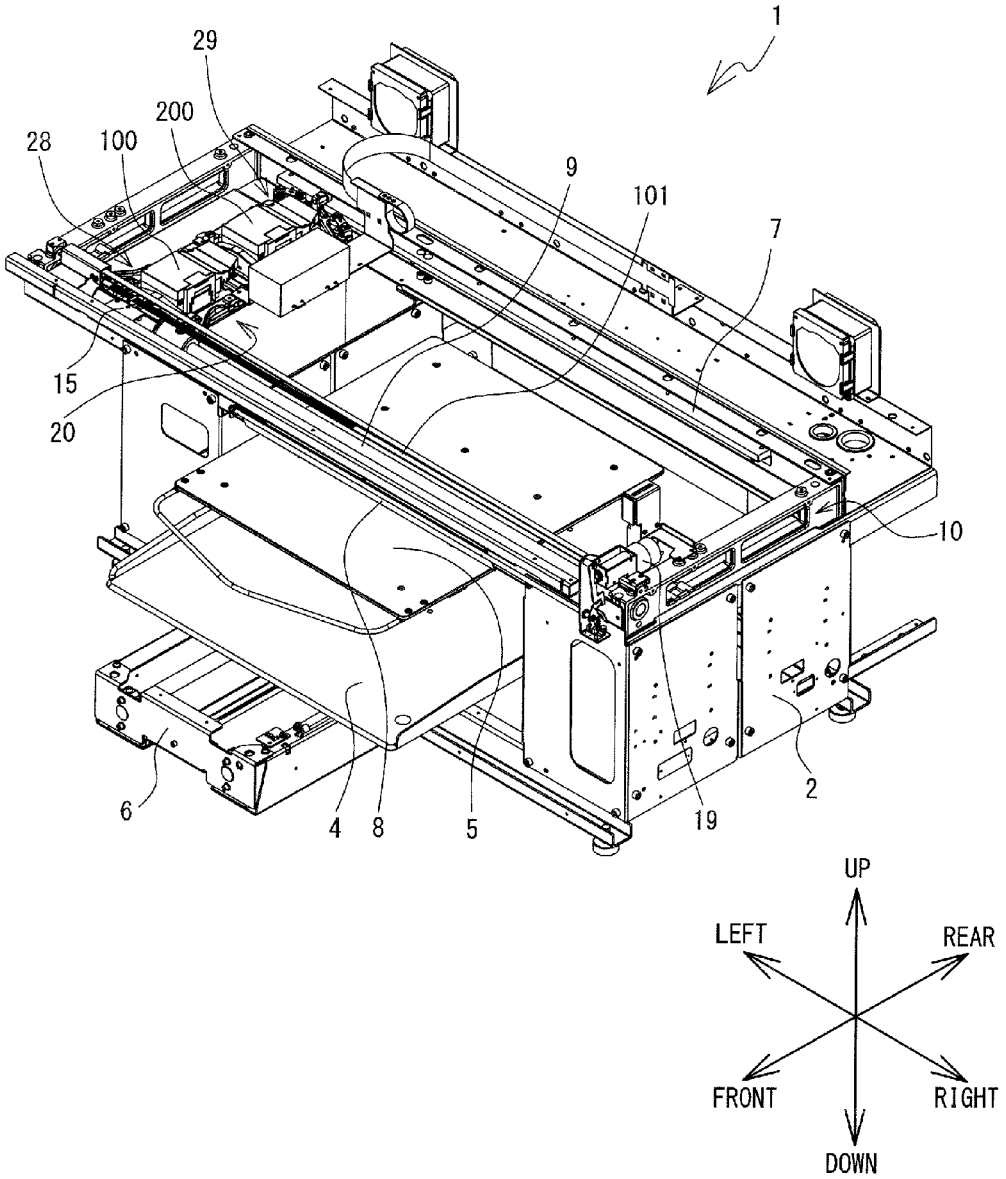
FIG. 1 is a perspective view of a printer 1.

As shown in FIG. 1, the printer 1 is an inkjet printer that performs printing by ejecting liquid ink onto a cloth (not shown in the drawings), such as a T shirt, which is a print medium. Paper or the like may be used as the print medium. In the present embodiment, the printer 1 can print a color image on the print medium by downwardly ejecting five types of ink that are different from each other. The five types of ink are white (W), black (K), yellow (Y), cyan (C) and magenta (M) inks. In the explanation below, of the five types of ink, the inks of the four colors of black, cyan, yellow and magenta are also collectively referred to as color inks, and the white color ink is referred to as a white ink. In the explanation below, a direction in which the printer 1 feeds the print medium (a front-rear direction, a sub-scanning direction) is also referred to as a first direction, and a direction that is orthogonal to the first direction (a left-right direction, a scanning direction) is also referred to as a second direction.

The printer 1 is mainly provided with a housing 2, a platen drive mechanism 6, a pair of guide rails 3 and 3, a platen 5, a tray 4, a frame body 10, a clearance sensor 8, a guide shaft 9, a rail 7, a carriage 20, support portions 21L and 21R, head units 100 and 200, a drive belt 101, a drive motor 19 and a board 15.

The housing 2 has a substantially cuboid shape whose long sides extend in the left-right direction. An operation portion (not shown in the drawings) to perform operations of the printer 1 is provided in a position on the front right side of the housing 2. The operation portion is provided with a display and operation buttons. The display displays various types of information. The operation buttons are operated when a user inputs commands relating to various types of operation of the printer 1.

Figure 2:
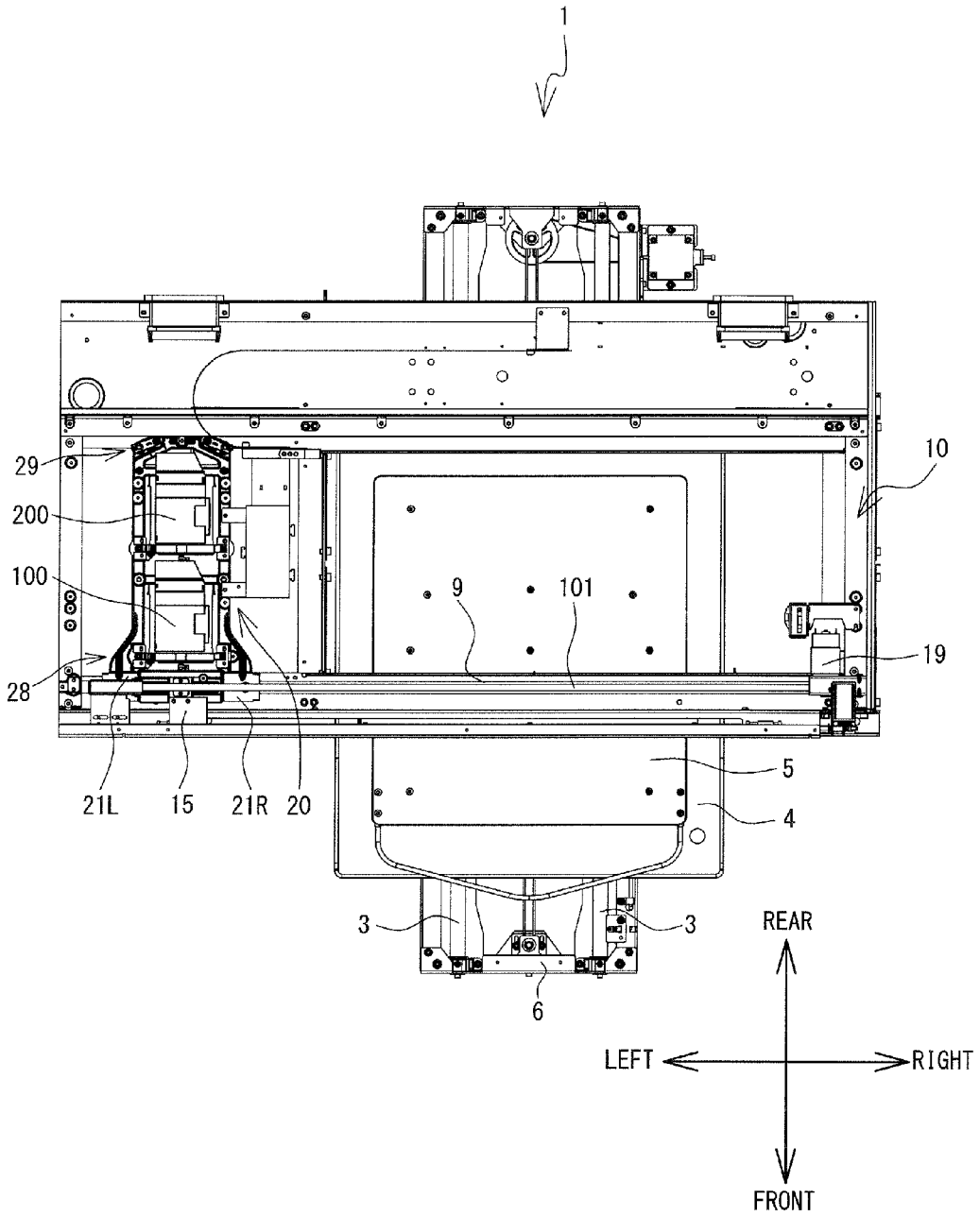
FIG. 2 is a plan view of the printer 1.

The platen drive mechanism 6 is provided with the pair of guide rails 3 and 3 (refer to FIG. 2). The pair of guide rails 3 and 3 support the platen 5 and the tray 4 such that the platen 5 and the tray 4 can be fed in the front-rear direction. The platen drive mechanism 6 uses, as a driving source, a motor (not shown in the drawings) that is provided on a rear end portion of the platen drive mechanism 6, and moves the platen 5 and the tray 4 in the front-rear direction of the housing 2 along the pair of guide rails 3 and 3. The platen 5 has a substantially rectangular plate shape in a plan view and the long sides of the platen 5 extend in the front-rear direction of the housing 2. The platen 5 is provided below the frame body 10 that will be described later. The print medium, which is a cloth, such as a T-shirt, for example, is placed on an upper surface of the platen 5. The tray 4 has a rectangular shape in a plan view and is provided below the platen 5. When the user places a T-shirt or the like on the platen 5, the tray 4 receives a sleeve or the like of the T-shirt and thus protects the sleeve or the like such that the sleeve or the like does not fall down into the housing 2.

The frame body 10 has a substantially rectangular frame shape in a plan view. The frame body 10 is installed on an upper portion of the housing 2. The clearance sensor 8 is provided to the front of the frame body 10 along the left-right direction of the frame body 10. When the platen 5 moves in the front-rear direction inside the housing 2 along the pair of guide rails 3 and 3 during printing by the printer 1, the clearance sensor 8 detects obstacles, such as wrinkling of or dirt on the cloth or the like that is placed on the platen 5.

The guide shaft 9 and the rail 7 are respectively supported on the inside of the frame body 10. The guide shaft 9 is a shaft member that is provided with a shaft-shaped portion that has a central axis line that extends in the second direction on the inside of the frame body 10. The rail 7 is a rod like member that is disposed facing the guide shaft 9 and that extends in the second direction. The guide shaft 9 and the rail 7 are separated from each other in the front-rear direction.

The carriage 20 is supported with respect to the guide shaft 9 such that the carriage 20 can be fed in the left-right direction along the guide shaft 9. The support portions 21L and 21R are provided on a first end portion 28, which is an end portion in the first direction of the carriage 20. The guide shaft 9 is inserted through the support portions 21L and 21R. The support portions 21L and 21R support the carriage 20 such that the carriage 20 can slide along the guide shaft 9. In other words, the support portions 21L and 21R are tubular-shaped and are engaged with the guide shaft 9. Although not shown in the drawings, a bearing mechanism is provided in each of the support portions 21L and 21R. Therefore, the carriage 20 can smoothly slide along the guide shaft 9. The head units 100 and 200 are mounted on the carriage 20. Head portions 105 and 205 that can eject ink toward the print medium are provided on bottom surfaces of the head units 100 and 200, respectively (refer to FIG. 4).

Although not shown in the drawings, the interior of each of the head portions 105 and 205 is divided into four sections along the left-right direction corresponding to the respective color inks. Planar ejection surfaces that are parallel to the horizontal plane are formed on the bottom surfaces of the head portions 105 and 205. A plurality of very fine ejection ports, each of which can eject one of the color inks downward, are provided in the ejection surface of the head portion 105. The plurality of ejection ports are arrayed from the front side to the rear side of the ejection surface along the front-rear direction, and form a plurality of rows that are arranged side by side in the left-right direction. The plurality of ejection ports correspond to a plurality of ejection channels (not shown in the drawings) that are provided inside the head portions 105 and 205. When the plurality of ejection channels are driven by a plurality of piezoelectric elements (not shown in the drawings) that are provided inside the head portions 105 and 205, the inks can be ejected downward from the ejection ports that respectively correspond to the plurality of ejection channels. More specifically, the head portion 105 includes an ejection port group having a plurality of ejection ports that eject black ink, an ejection port group having a plurality of ejection ports that eject cyan ink, an ejection port group having a plurality of ejection ports that eject yellow ink, and an ejection port group having a plurality of ejection ports that eject magenta ink. Further, the head portion 205 ejects white ink. Similarly to the head portion 105, the head portion 205 is divided into four sections. However, all the ejection ports of the head portion 205 eject the white ink. In the explanation below, the lower side that is the direction toward which the head portions 105 and 205 of the respective head units 100 and 200 eject ink is also referred to as a first side, and the upper side that is an opposite side to the first side is also referred to as a second side.

The drive belt 101 is strip-shaped, and is stretched along the left-right direction on the inside of the frame body 10. The drive belt 101 is made of flexible resin. The drive motor 19 is provided on the front right side on the inside of the frame body 10. The drive motor 19 is provided between the guide shaft 9 and the rail 7 in the front-rear direction. The drive motor 19 can rotate in the forward direction and the reverse direction. The drive motor 19 is coupled to the carriage 20 via the drive belt 101. When the drive motor 19 moves the drive belt 101, the carriage 20 is caused to reciprocate in the second direction. The carriage 20 causes the head portions 105 and 205 of the respective head units 100 and 200 to reciprocate in the second direction that is orthogonal to the first direction.

An optical sensor (not shown in the drawings) that detects a position of the carriage 20 in the second direction is provided on a lower side surface of the board 15. The board 15 is fixed to the first end portion 28 of the carriage 20 using screws. The board 15 moves in the second direction in accordance with the reciprocating movement of the carriage 20 in the second direction. The optical sensor is electrically connected to the board 15. An encoder strip (not shown in the drawings) is disposed on the outside of the front side of the frame body 10. The encoder strip extends in a strip shape in the second direction. A pattern that indicates the position of the carriage 20 in the second direction is formed on the encoder strip. A light transmitting portion that allows light to pass through it and a light shielding portion that blocks light are alternately arranged on the pattern at an equal pitch in the longitudinal direction, and this pattern is described in the encoder strip. A signal based on the pattern detected by the optical sensor is output to the board 15. A control portion that is formed by various electronic devices installed on the board 15 acquires the position of the carriage 20 in the second direction based on the aforementioned signal. The board 15 outputs position information of the carriage 20 in the second direction to a main board (not shown in the drawings) that performs main control of the printer 1. Based on the position information output from the board 15, the main board controls the driving of the drive motor 19 and the driving of the plurality of piezoelectric elements provided inside the head portions 105 and 205.

Figure 3:
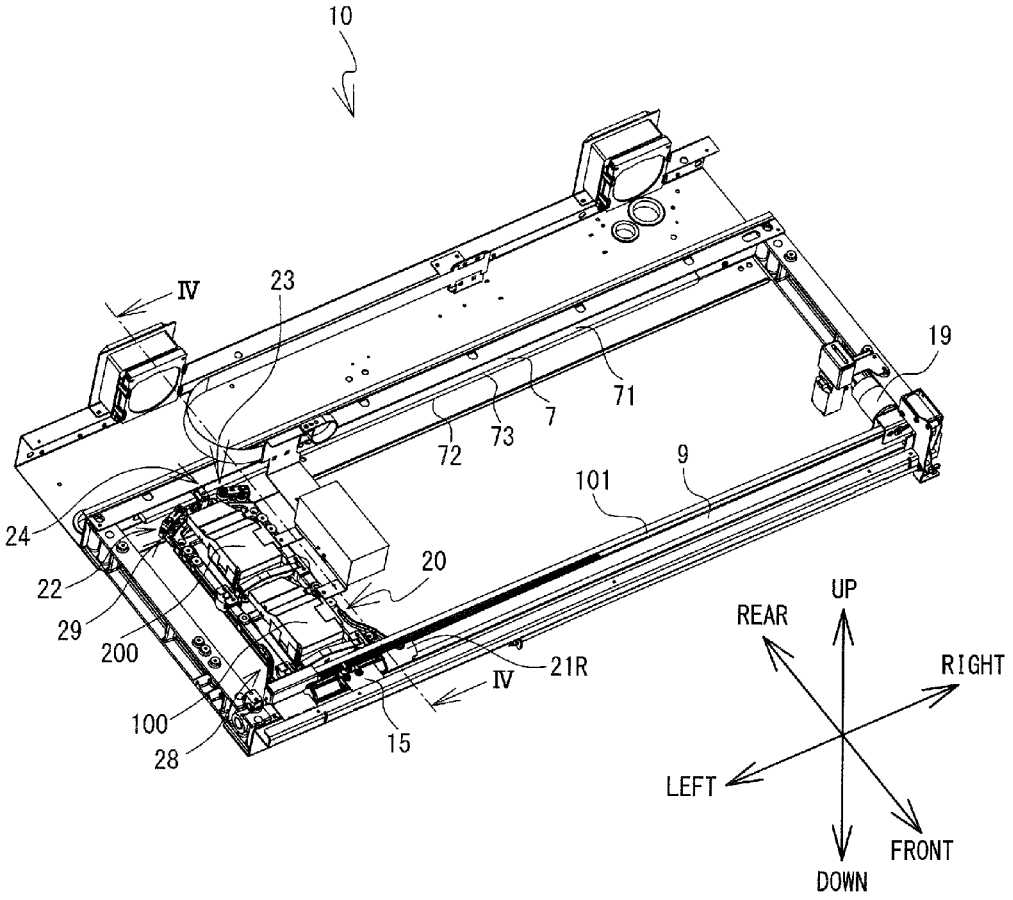
FIG. 3 is a perspective view of a frame body 10.

The structure of the frame body 10 will be explained in detail with reference to FIG. 3 and FIG. 4. The frame body 10 supports the guide shaft 9 on the front side and supports the rail 7 on the rear side, on the inside of the frame body 10. The carriage 20 is disposed in the front-rear direction between the guide shaft 9 and the rail 7. A left-side pressing portion 22, a right-side pressing portion 23, a regulating portion 24 and a lower-side pressing portion 25 are provided on a second end portion 29, which is on the opposite side to the first end portion 28 of the carriage 20 (namely, the second end portion 29 is on the rear side of the carriage 20). The left-side pressing portion 22 and the right-side pressing portion 23 press a front surface 73 of the rail 7, which is on a side (the front side) facing the guide shaft 9, horizontally toward the rear side. The regulating portion 24 comes into contact with an upper surface 71, which is a surface on the second side of the rail 7, and regulates the movement of the carriage 20 toward the first side. The lower-side pressing portion 25 upwardly presses a lower surface 72, which is a surface on the first side of the rail 7. In other words, the second end portion 29 of the carriage 20 is in contact with the rail 7 at the left-side pressing portion 22, the right-side pressing portion 23, the regulating portion 24 and the lower-side pressing portion 25.

Figure 4:
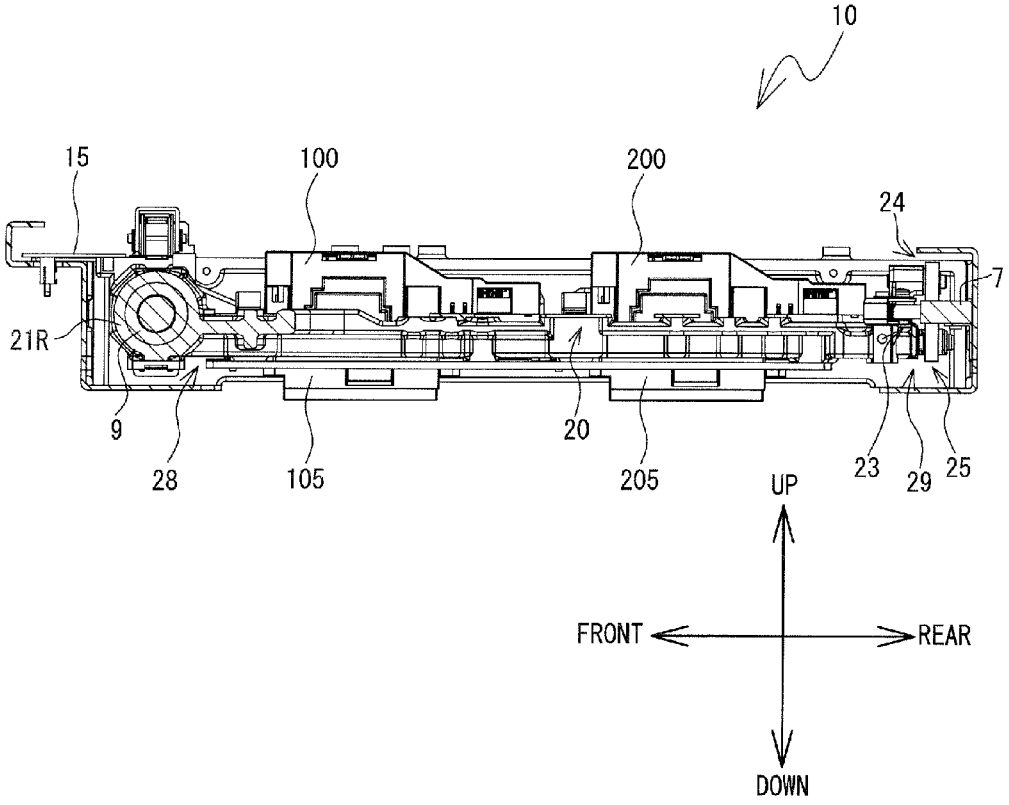
FIG. 4 is a cross-sectional view in the direction of arrows taken along a line IV-IV shown in FIG. 3.

As shown in FIG. 4, the head units 100 and 200 are arrayed in the first direction on the carriage 20 such that the ejection surfaces of the head portions 105 and 205 of the respective head units 100 and 200 are directed downward. The carriage 20 supports the head units 100 and 200 such that the ejection surfaces of the respective head portions 105 and 205 are arranged at the same height. The head unit 100 is positioned to the front of the head unit 200. The head units 100 and 200 can reciprocate along the guide shaft 9 in the left-right direction on the inside of the frame body 10. The head unit 100 ejects the color inks from the head portion 105, and the head unit 200 ejects the white ink from the head portion 205.

In the present embodiment, for example, when the color of the print medium is dark, before the color inks are ejected, the white ink is ejected onto all or a part of the area to be printed, as a base for printing. In summary, the white ink is a pre-treatment ink. After the white ink has been ejected onto all or a part of the area to be printed, the color inks are used to print a pattern etc. on the area onto which the white ink has been ejected. In summary, each of the color inks is a post-treatment ink. In other words, the head unit 200 is a head unit for pre-treatment, and the head unit 100 is a head unit for post-treatment. Therefore, the head unit 100 that ejects the post-treatment inks is required to eject the inks at a higher precision than the head unit 200 that ejects the pre-treatment ink. Note that the white ink is also used as a post-treatment ink to print a pattern etc. As described above, the printer 1 can perform various types of printing regardless of the color of the print medium.

Note that, depending on the color of the print medium and a printing image, the color inks for post-treatment need not necessarily be ejected after the white ink for pre-treatment has been ejected. More specifically, there may be an area onto which the white ink for pre-treatment only is ejected or an area onto which the color inks for post-treatment only are ejected. Further, in the present embodiment, the white ink is used as the pre-treatment ink and the color inks are used as the post-treatment inks. However, the combination of the pre-treatment ink and the post-treatment inks and the ink type etc. can be changed as appropriate and are not limited to the case of the present embodiment.

Note that, it is sufficient if the printer 1 of the present embodiment is provided with at least the single head unit 100. Further, the number of the head units is not limited to the example of the present embodiment, and three or more head units that are arrayed in the first direction may be mounted on the carriage 20. Further, the form of the ejection port groups that are provided on the head units 100 and 200 is not limited to the above-described example. For example, the head unit may be provided with a single ejection port group that ejects one type of liquid. The ejection port group that ejects the white ink and the ejection port groups that eject the color inks may be provided on the same head unit. Further, the head unit may include not only the ejection port group that ejects ink, but also an ejection port group that ejects a discharging agent, a discharge ink or the like.

Figure 5:
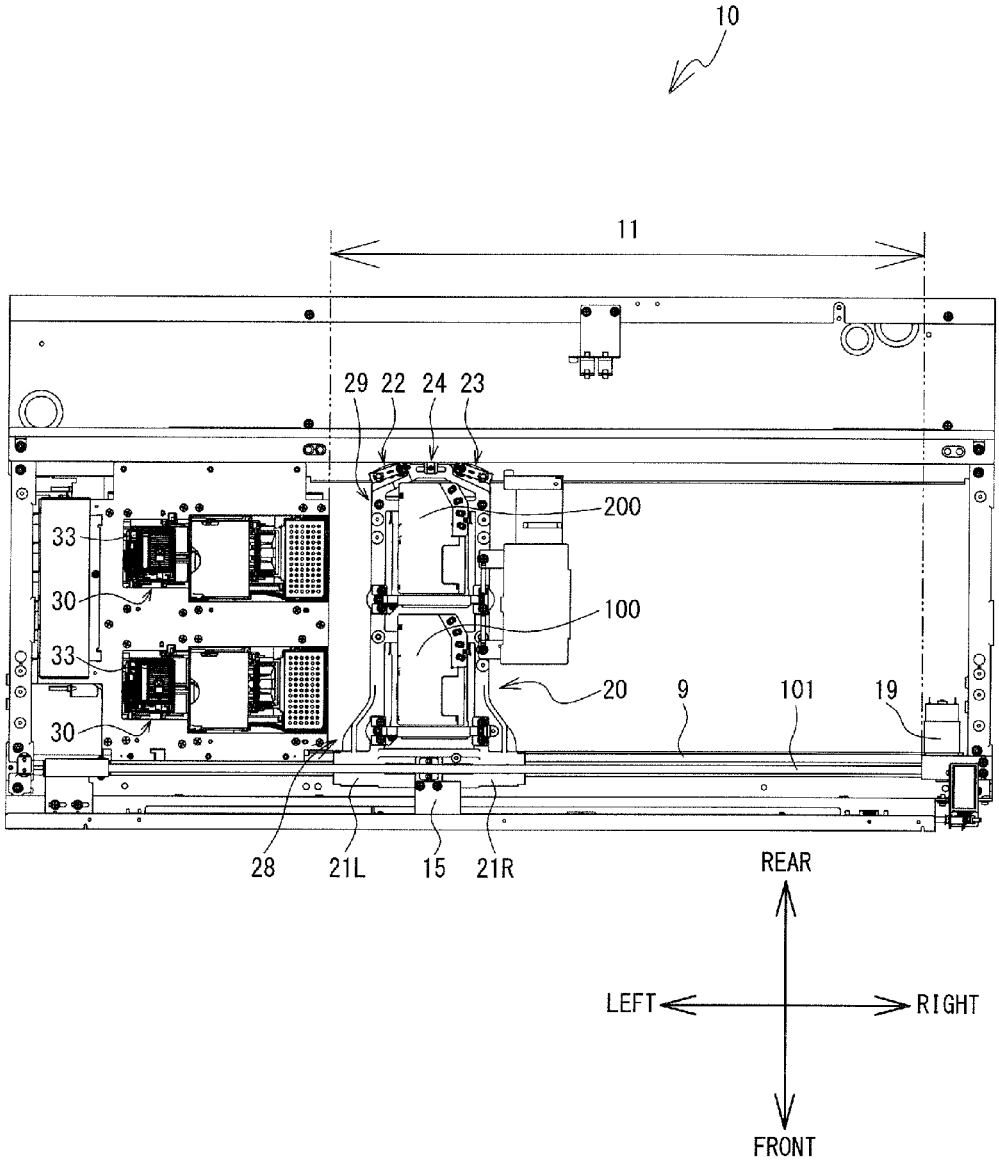
FIG. 5 is a plan view of the frame body 10 when a carriage 20 is in a printing area 11.
Figure 6:
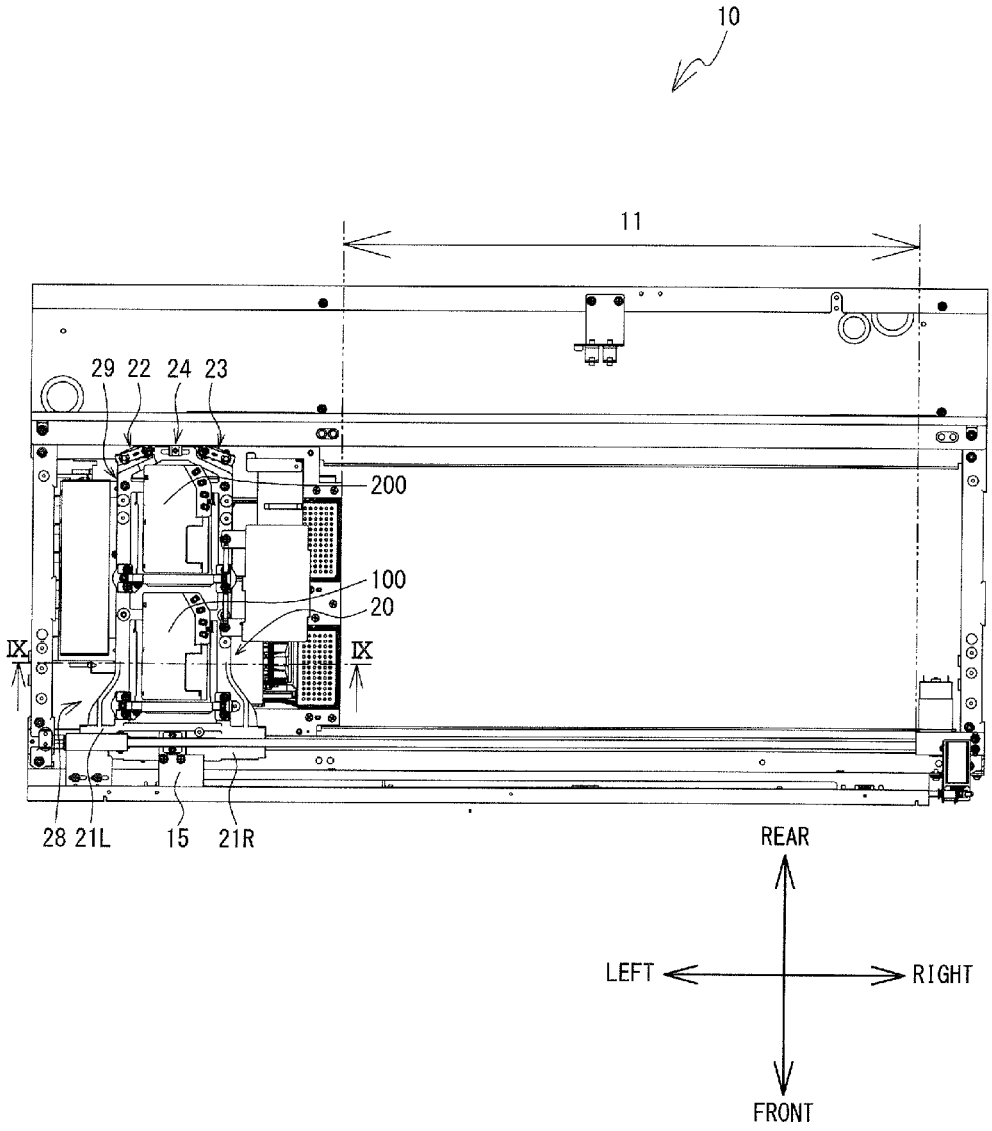
FIG. 6 is a plan view of the frame body 10 when the carriage 20 is at an origin position.

An arrangement of the two purge units 30 and 30 will be explained with reference to FIG. 5 and FIG. 6. A printing area 11 is a long area that extends from the right end of a movement path of the carriage 20 to a position close to the left end. A left end portion of the movement path, which is to the left of the printing area 11, is an origin position of the carriage 20. The two purge units 30 and 30 are provided below the origin position of the carriage 20.

Each of the purge units 30 and 30 is a mechanism to perform a purge operation with respect to each of the head units 100 and 200 mounted on the carriage 20, when the carriage 20 is at the origin position. The purge operation is an operation that discharges ink containing foreign matter or bubbles etc. from the head portions 105 and 205. By performing the purge operation with respect to each of the head units 100 and 200 using the purge units 30 and 30, the purge units 30 and 30 can eliminate clogging of the head portions 105 and 205. Each of the purge units 30 and 30 has a nozzle cap 33 that can be firmly attached to and detached from the ejection surface of each of the head portions 105 and 205, from the first side. When the carriage 20 has moved to the origin position, the nozzle caps 33 are respectively provided in positions facing the ejection surfaces of the head portions 105 and 205. Each of the purge units 30 and 30 is provided with a suction pump (not shown in the drawings). The purge units 30 and 30 can suction ink containing foreign matter or bubbles etc. from the head portions 105 and 205, via the nozzle caps 33. When printing is not performed, the ejection surface of each of the head portions 105 and 205 is covered with the nozzle cap 33, and thus sealing performance between the ejection surface and the nozzle cap 33 is secured.

Figure 7:
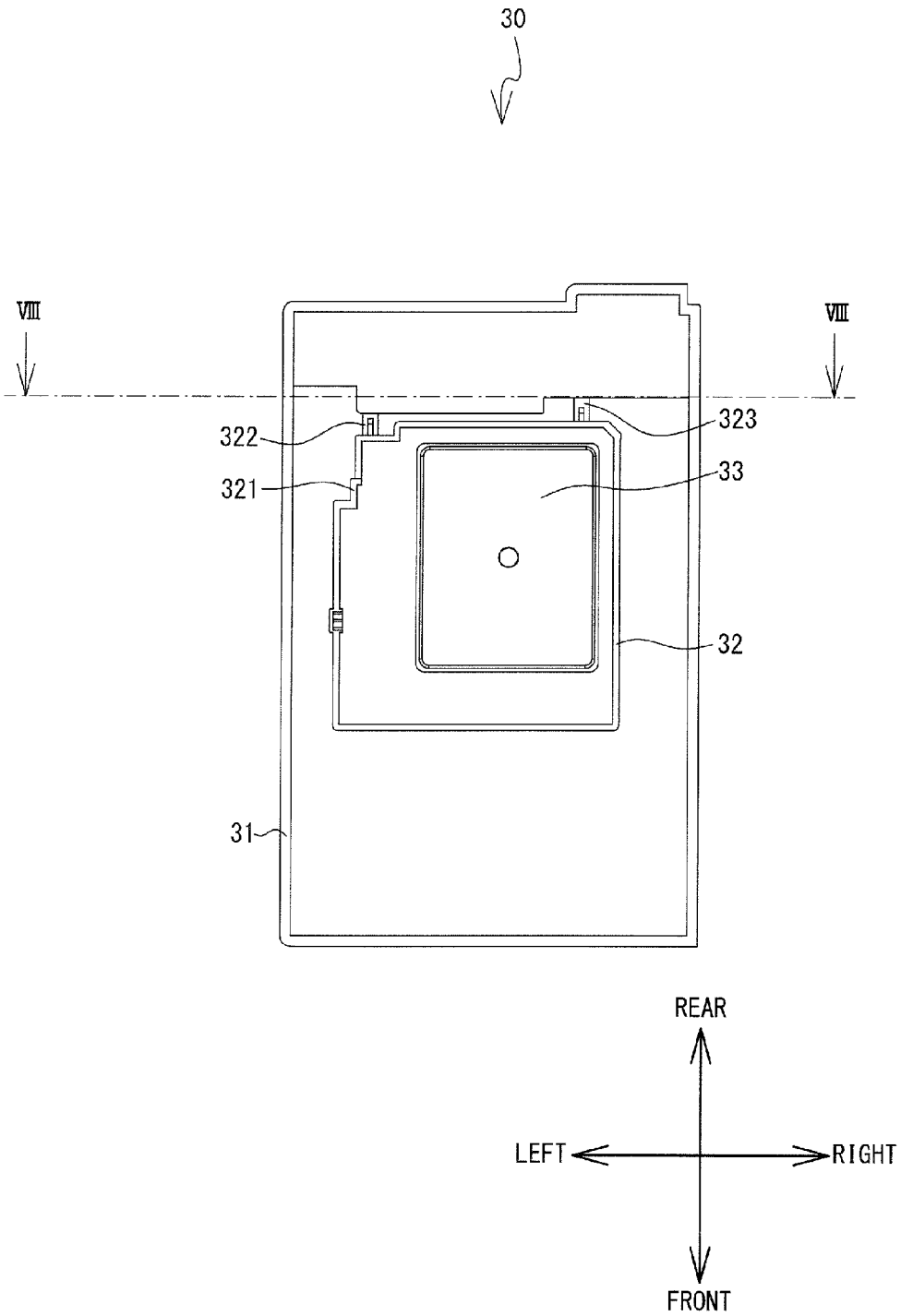
FIG. 7 is a plan view of a purge unit 30.

The structure of the purge unit 30 will be explained with reference to FIG. 7 to FIG. 9. As shown in FIG. 7, the purge unit 30 is provided with a main body portion 31, a cap holder 32, the nozzle cap 33 and the like. The main body portion 31 is a substantially cuboid-shaped (box-shaped) support body, and movably supports the cap holder 32. The cap holder 32 has a substantially box shape whose upper side is open, and is provided on an upper portion of the main body portion 31. The nozzle cap 33 is placed on the inner side of the cap holder 32. The nozzle cap 33 has a substantially cuboid shape whose long sides extend in the front-rear direction, and has an open recessed portion on the upper surface side. In the present embodiment, the nozzle cap 33 is made of silicone rubber. The left end of the cap holder 32 is provided with a standing portion 321 that stands upward. The rear end of the cap holder 32 is provided with two shaft portions 322 and 323 that protrude rearward.

Figure 8:
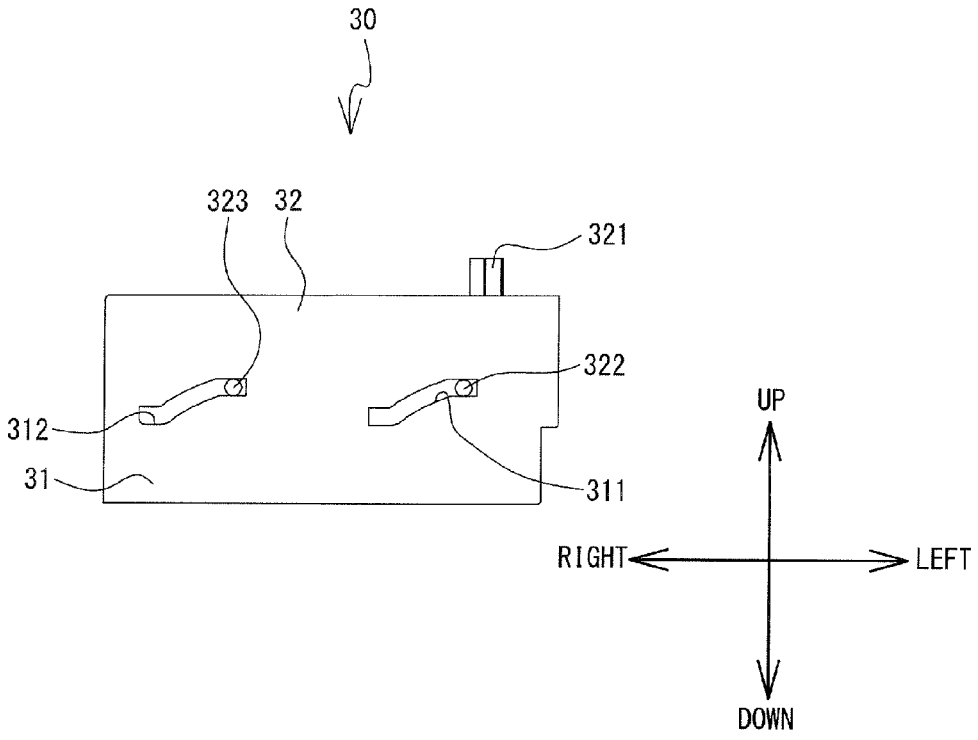
FIG. 8 is a cross-sectional view in the direction of arrows taken along a line VIII-VIII shown in FIG. 7.
Figure 9:
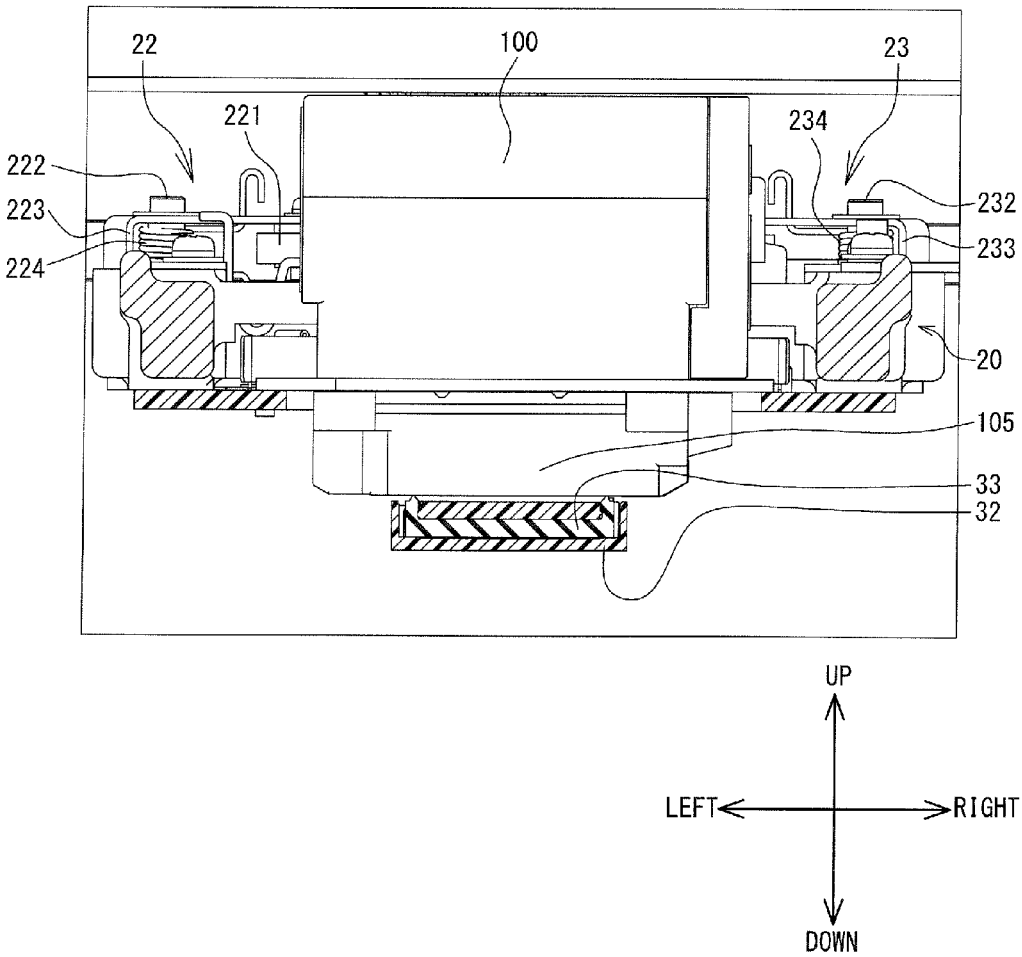
FIG. 9 is a cross-sectional view in the direction of arrows taken along a line IX-IX shown in FIG. 6.

As shown in FIG. 8, a cutout portion 311 that receives the shaft portion 322, and a cutout portion 312 that receives the shaft portion 323 are provided inside the main body portion 31. A left end portion of the cutout portion 311 is provided in a position higher than a right end portion of the cutout portion 311. The left end portion and the right end portion of the cutout portion 311 are communicatively connected by a path that is inclined upward and to the left. The cutout portion 312 is also formed in the same manner as the cutout portion 311. In a process in which the carriage 20 moves from the printing area 11 to the origin position, the carriage 20 comes into contact with the standing portion 321 from the right side immediately before the carriage 20 reaches the origin position, and presses and moves the cap holder 32 to the left. After that, until the carriage 20 reaches the origin position, the carriage 20 continues to press the standing portion 321, and the shaft portion 322 and the shaft portion 323 move from the right side to the left side inside the cutout portion 311 and the cutout portion 312, respectively. Therefore, when the carriage 20 continues to press the standing portion 321, the shaft portions 322 and 323 gradually raise the cap holder 32 while they are moving from the right side to the left side inside the cutout portions 311 and 312, respectively.

The position of the cap holder 32 when the shaft portions 322 and 323 are respectively positioned at the low positions in the right end portions of the cutout portions 311 and 312 is referred to as a standby position. The position of the cap holder 32 when the shaft portions 322 and 323 are respectively positioned at the high positions in the left end portions of the cutout portion 311 and 322 is referred to as a firmly attached position. The nozzle cap 33 moves integrally with the cap holder 32. In a state in which the cap holder 32 is in the standby position, the nozzle cap 33 stands by in a position lower than the ejection surface of each of the head portions 105 and 205. In a process in which the cap holder 32 is pressed by the carriage 20 and moves diagonally leftward and upward toward the firmly attached position, the upper end edge of the nozzle cap 33 approaches the ejection surface of each of the head portions 105 and 205. In a state in which the cap holder 32 has been displaced to the firmly attached position, the upper end edge of the nozzle cap 33 is firmly attached to the ejection surface of each of the head portions 105 and 205 in an airtight manner (refer to FIG. 9). As described above, in the printer 1, the carriage 20 is configured to press and move the cap holder 32. Therefore, it is not necessary to provide a driving source dedicated to displacing the cap holder 32 between the standby position and the firmly attached position.

In the present embodiment, when the carriage 20 reaches the origin position, the nozzle caps 33 are firmly attached to the ejection surfaces of the respective head portions 105 and 205 from the first side and cover the head portions 105 and 205. In order to form an airtight space between the nozzle caps 33 and the ejection surfaces of the respective head portions 105 and 205, the nozzle caps 33 are pressed against the ejection surfaces of the respective head portions 105 and 205. Therefore, the carriage 20 at the origin position receives an upward force from the nozzle caps 33. When the carriage 20 receives the upward force from the nozzle caps 33, the distance between the nozzle caps 33 and the head portions 105 and 205 changes. As a result, it may be difficult to maintain the airtightness between the nozzle caps 33 and the ejection surfaces of the respective head portions 105 and 205. Particularly in the present embodiment, the two head units 100 and 200 are mounted on the carriage 20. Therefore, the head units 100 and 200 are provided with the purge units 30 and 30, respectively. Accordingly, the carriage 20 receives an upward force from the two purge units 30 and 30. Also in the above-described case, it is possible to suppress a change in the distance between the nozzle caps 33 and the head portions 105 and 205, by the regulating portion 24 and the lower-side pressing portion 25 reliably supporting the carriage 20 with respect to the rail 7 in the up-down direction. More specifically, even when the carriage 20 at the origin position receives the upward force from the nozzle caps 33 and the distance between the nozzle caps 33 and the head portions 105 and 205 changes, the sealing performance between the nozzle caps 33 and the head portions 105 and 205 of the printer 1 can be secured by configuring the carriage 20 in the following manner.

A structure of the second end portion 29 of the carriage 20 will be explained in detail with reference to FIG. 10 to FIG. 14. Note that, in FIG. 11 to FIG. 13, in order to explain an eccentric member 243 that will be described later, the regulating portion 24 is depicted such that it is cut in the horizontal direction.

Figure 10:
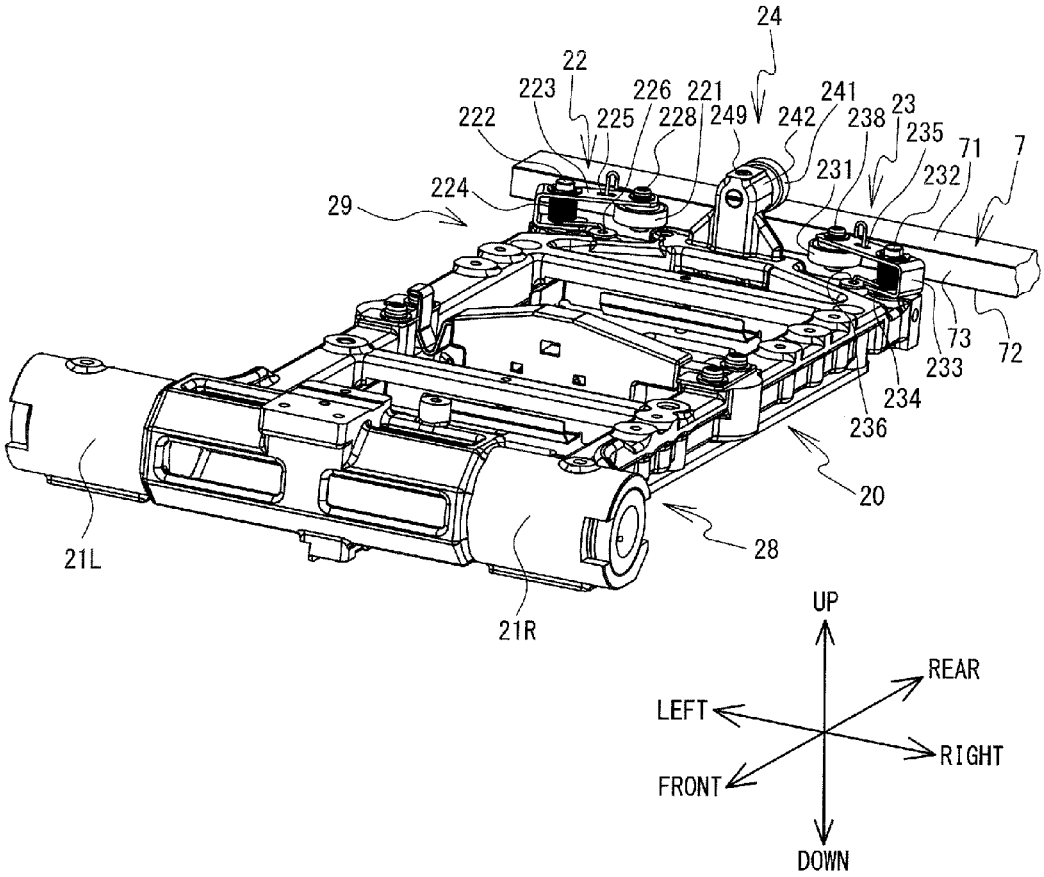
FIG. 10 is a perspective view of the carriage 20 when viewed from the front right side.
Figure 11:
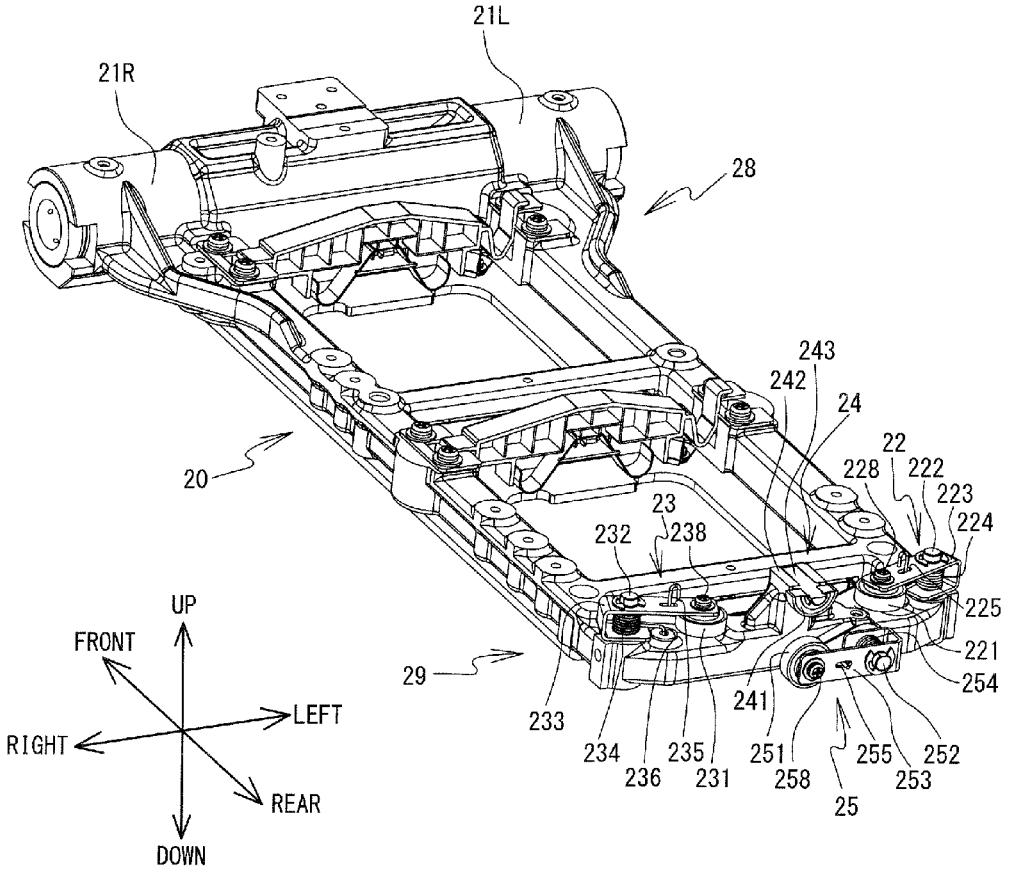
FIG. 11 is a perspective view of the carriage 20 when viewed from the rear right side.

As shown in FIG. 10, the carriage 20 is provided with the left-side pressing portion 22 and the right-side pressing portion 23, respectively, on both ends in the second direction of the second end portion 29. Specifically, the left-side pressing portion 22 is disposed on the left side of the second end portion 29 and the right-side pressing portion 23 is disposed on the right side of the second end portion 29. The left-side pressing portion 22 presses the rail 7 rearward on the left side of the second end portion 29. The right-side pressing portion 23 presses the rail 7 rearward on the right side of the second end portion 29. As shown in FIG. 11, the carriage 20 is provided with the lower-side pressing portion 25 and the regulating portion 24. The lower-side pressing portion 25 is disposed on the second end portion 29, between the left-side pressing portion 22 and the right-side pressing portion 23. The regulating portion 24 is disposed on the second side of the lower-side pressing portion 25 such that the regulating portion 24 faces the lower-side pressing portion 25. The lower-side pressing portion 25 presses the rail 7 upward.

As shown in FIG. 10 and FIG. 11, the right-side pressing portion 23 is mainly provided with a support shaft 232, an arm portion 233, a support member 238, a contact portion 231 and a coil spring 234. The support shaft 232 is a shaft member that stands at the right end of the second end portion 29 and extends toward the second side. The support shaft 232 is provided with the arm portion 233 and the coil spring 234. The arm portion 233 is provided such that it can swing around the support shaft 232. The support member 238 rotatably supports the contact portion 231, on an end portion of the arm portion 233 on an opposite side to the support shaft 232. The contact portion 231 is cylindrically shaped and is made of urethane rubber in the present embodiment. The contact portion 231 comes into contact with the front surface 73 of the rail 7 (refer to FIG. 3 and FIG. 10). The coil spring 234 is wound around the support shaft 232. An end portion on the upper side of the coil spring 234 is fixed to a fixed portion 235 that is provided in the center in the longitudinal direction of the arm portion 233. An end portion on the lower side of the coil spring 234 is fixed to a fixed portion 236 that is provided on the second end portion 29. The coil spring 234 is an urging member that urges the arm portion 233 in a direction in which the contact portion 231 comes into contact with the front surface 73. By the coil spring 234 urging the arm portion 233, the contact portion 231 can press the front surface 73 rearward.

The left-side pressing portion 22 is mainly provided with a support shaft 222, an arm portion 223, a support member 228, a contact portion 221 and a coil spring 224. The support shaft 222 is a shaft member that stands at the left end of the second end portion 29 and extends toward the second side. The support shaft 222 fixes the arm portion 223 and the coil spring 224. The arm portion 223 is provided such that it can swing around the support shaft 222. The support member 228 rotatably supports the contact portion 221, on an end portion of the arm portion 223 on an opposite side to the support shaft 222. In the same manner as the contact portion 231, the contact portion 221 is also cylindrically shaped and is made of urethane rubber. The contact portion 221 comes into contact with the front surface 73 of the rail 7 (refer to FIG. 3 and FIG. 10). The coil spring 224 is wound around the support shaft 222. An end portion on the upper side of the coil spring 224 is fixed to a fixed portion 225 that is provided in the center in the longitudinal direction of the arm portion 223. An end portion on the lower side of the coil spring 224 is fixed to a fixed portion 226 (refer to FIG. 10) that is provided on the second end portion 29. The coil spring 224 is an urging member that urges the arm portion 223 in a direction in which the contact portion 221 comes into contact with the front surface 73. By the coil spring 224 urging the arm portion 223, the contact portion 221 can press the front surface 73 rearward. Although the left-side pressing portion 22 is configured similarly to the right-side pressing portion 23, the support shaft 222, the arm portion 223, the contact portion 221 and the coil spring 224 are arranged to be symmetrical with respect to the support portion 232, the arm portion 233, the contact portion 231 and the coil spring 234 of the right-side pressing portion 23.

The lower-side pressing portion 25 is mainly provided with a support shaft 252, an arm portion 253, a support member 258, a contact portion 251 and a coil spring 254. The support shaft 252 is a shaft member that protrudes rearward from the rear end of the second end portion 29 of the carriage 20. The support shaft 252 fixes the arm portion 253 and the coil spring 254 (refer to FIG. 11). The arm portion 253 is provided such that it can swing around the support shaft 252. The support member 258 rotatably supports the contact portion 251, on an end portion of the arm portion 253 on an opposite side to the support shaft 252. The contact portion 251 is cylindrically shaped and is made of urethane rubber. The contact portion 251 comes into contact with the lower surface 72, which is on the opposite side to the upper surface 71 of the rail 7 (refer to FIG. 13). The coil spring 254 is wound around the support shaft 252. An end portion on the upper side of the coil spring 254 is fixed to a fixed portion 255 that is provided in the center in the longitudinal direction of the arm portion 253. An end portion on the lower side of the coil spring 254 is fixed to a fixed portion 256 that is provided on the second end portion 29. The coil spring 254 is an urging member that urges the arm portion 253 in a direction in which the contact portion 251 comes into contact with the lower surface 72. By the coil spring 254 urging the arm portion 253, the contact portion 251 can press the lower surface 72 upward.

The regulating portion 24 is mainly provided with a fixed portion 242, a contact portion 241, the eccentric member 243 and a prohibition portion 249. The regulating portion 24 is disposed on the second side of the lower-side pressing portion 25. The fixed portion 242 stands at substantially the center of the second end portion 29 and extends toward the second side. The contact portion 241 is cylindrically shaped and is made of urethane rubber. In the fixed portion 242, the contact portion 241 is rotatably supported by the eccentric member 243. The contact portion 241 comes into contact with the upper surface 71 of the rail 7 from above (refer to FIG. 10). The prohibition portion 249 fixes the eccentric member 243 to the fixed portion 242, and thus prohibits the eccentric member 243 from rotating (refer to FIG. 10). In the present embodiment, the prohibition portion 249 is formed by a setscrew (a screw whose head portion has the same size as a screw portion). Since the prohibition portion 249 is screwed and fixed to the fixed portion 242, the prohibition portion 249 can press and fix a rotating shaft portion 244 (which will be described later) to an inner portion of the fixed portion 242. Note that a method for fixing the eccentric member 243 to the fixed portion 242 is not limited to the fixing by the setscrew. Instead of the setscrew, another member or method that can prohibit the eccentric member 243 from rotating may be used.

Figure 13:
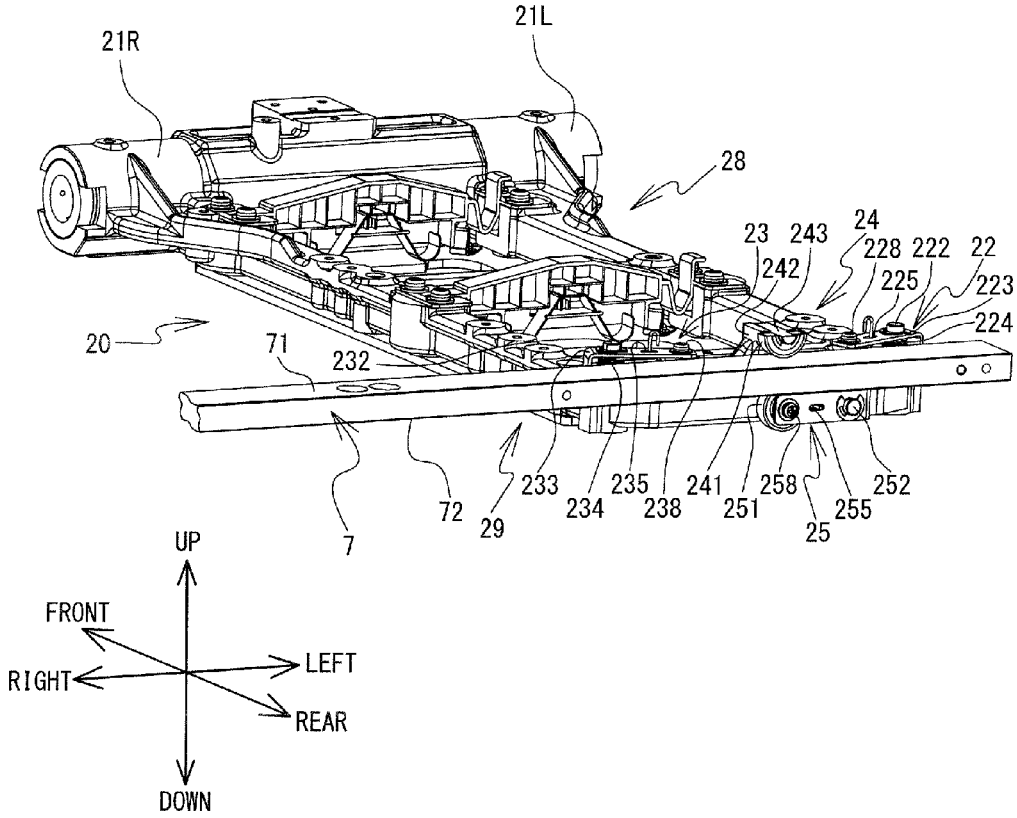
FIG. 13 is a perspective view of the carriage 20 when viewed from the rear right side.

As shown in FIG. 13, a lower end portion of the contact portion 241 comes into contact with the upper surface 71 of the rail 7 from above, and regulates the downward movement of the second end portion 29 of the carriage 20. An upper end portion of the contact portion 251 presses the lower surface 72 upward from below. In other words, the contact portion 241 and the contact portion 251 clamp the rail 7 in the up-down direction, and thus determine the height of the second end portion 29.

Figure 12:
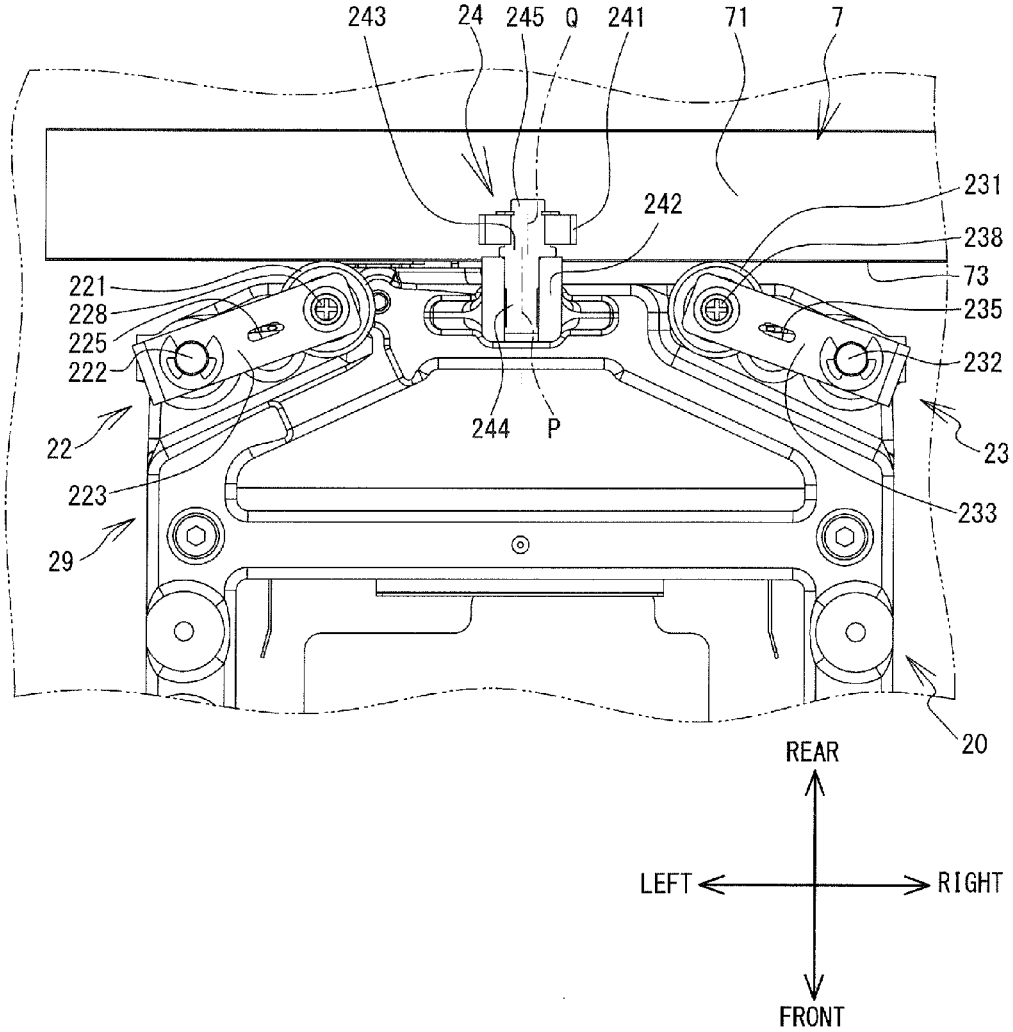
FIG. 12 is an enlarged plan view of a second end portion 29.

The eccentric member 243 will be explained with reference to FIG. 12. As shown in FIG. 12, the eccentric member 243 is disposed at the rear end of the second end portion 29 of the carriage 20, between the left-side pressing portion 22 and the right-side pressing portion 23. The eccentric member 243 is provided with the rotating shaft portion 244 and an eccentric shaft portion 245. The rotating shaft portion 244 is axially supported by the fixed portion 242 and has a central axis P that extends in the first direction. The eccentric shaft portion 245 has a central axis Q that is eccentric with respect to the central axis P. The contact portion 241 is supported by the eccentric shaft portion 245 such that it can rotate around the central axis Q.

As described above, in the present embodiment, the first end portion 28 of the carriage 20 is provided with the support portions 21L and 21R that are engaged with the guide shaft 9. Further, the second end portion 29 of the carriage 20 is provided with the left-side pressing portion 22, the right-side pressing portion 23, the regulating portion 24 and the lower-side pressing portion 25 that are in contact with the rail 7. In the structure described above, the number of components that are disposed on the second end portion 29 side of the carriage 20 is larger than the number of components that are disposed on the first end portion 28 side of the carriage 20. When the number of components is increased, a problem is likely to occur due to a design error that is accumulated between the components. Further, in the present embodiment, the support portions 21L and 21R are configured to support the guide shaft 9 by the guide shaft 9 being inserted through the support portions 21L and 21R. Therefore, the position of the first end portion 28 with respect to the guide shaft 9 is unlikely to be displaced. Accordingly, tolerances that are accumulated on the second end portion 29 side tend to be larger than tolerances that are accumulated on the first end portion 28 side.

When the tolerances that are accumulated on the first end portion 28 side are different from the tolerances that are accumulated on the second end portion 29 side and the influence of the tolerances occurs in the up-down direction, there is a possibility that the position (height) in the up-down direction of the carriage 20 on the first end portion 28 side is slightly different from the position (height) in the up-down direction of the carriage 20 on the second end portion 29 side. When the height of the carriage 20 on the first end portion 28 side is different from the height of the carriage 20 on the second end portion 29 side, the height of the head unit 100 mounted on the first end portion 28 side is different from the height of the head unit 200 mounted on the second end portion 29 side. As a result, it is difficult for the carriage 20 to maintain the ejection surfaces of the respective head units 105 and 205 at the same height. In the present embodiment, the nozzle caps 33 are firmly attached, from the first side, to the ejection surfaces of the respective head portions 105 and 205 mounted on the carriage 20 that is at the origin position. Therefore, when the heights of the ejection surfaces of the respective head portions 105 and 205 are different from each other, a difference is likely to occur in the adherence of the nozzle caps 33 with respect to the ejection surfaces of the respective head portions 105 and 205. When the difference in the adherence of the nozzle caps 33 with respect to the ejection surfaces occurs, the purge unit 30 cannot sufficiently perform the purge operation on one of the head portions 105 and 205 for which the adherence of the nozzle cap 33 is poor. As a result, there is a case in which the clogging of the head cannot be eliminated sufficiently. Further, when the nozzle caps 33 cannot cover the ejection surfaces of the respective head portions 105 and 205 while maintaining the sealing performance, the head portions 105 and 205 are likely to be affected by the external environment. Further, when the ejection surfaces are not covered while the sealing performance is maintained, depending on a type of the ink, it is not possible to sufficiently inhibit the drying of the ink on the ejection surfaces. Further, there is a possibility of an ejection failure of the ink.

In the present embodiment, the central axis Q of the eccentric member 243 is eccentric with respect to the central axis P by one millimeter. Due to the above-described structure, when the rotating shaft portion 244 that is axially supported by the fixed portion 242 rotates, the central axis Q is displaced within the range of one millimeter in the upward direction and the downward direction, respectively. In accordance with the rotation of the rotating shaft portion 244, the contact portion 241 that is supported around the central axis Q by the eccentric shaft portion 245 moves integrally with the eccentric shaft portion 245. More specifically, due to the rotation of the rotating shaft portion 244, the printer 1 can slightly adjust the position of the contact portion 241 in the up-down direction within a predetermined range. The positioning of the second end portion 29 of the carriage 20 in the up-down direction is performed by the contact portion 241 and the contact portion 251 clamping the rail 7 in the up-down direction. Therefore, when the rotating shaft portion 244 rotates by a predetermined amount and the position of the contact portion 241 is slightly adjusted in the up-down direction, it is possible to slightly adjust the height of the second end portion 29. Then, in the state in which the first end portion 28 and the second end portion 29 have been adjusted to the same height, when the prohibition portion 249 (refer to FIG. 10) is used to fix the rotating shaft portion 244 to the fixed portion 242, the slight difference in height between the first end portion 28 side and the second end portion 29 side can be eliminated by adjustment. Therefore, in the printer 1, the distance between the nozzle cap 33 and the ejection surface of each of the head portions 105 and 205 is maintained uniformly so that the ejection surface of each of the head portions 105 and 205 is parallel to the nozzle cap 33, and it is possible to improve the adherence of the nozzle cap 33 with respect to the ejection surface of each of the head portions 105 and 205.

Note that, as described above, the head unit 100 that ejects the post-treatment inks is required to eject the inks with higher accuracy than the head unit 200 that ejects the pre-treatment ink. Therefore, in the printer 1, the head unit 100 is disposed on the first end portion 28 side that is more unlikely to be affected by the tolerances than the second end portion 29 side, and the head unit 200 is disposed on the second end portion 29 side (refer to FIG. 4). With the above-described structure, the nozzle cap 33 reliably comes into contact with the head portion 205 of the head unit 200, and printing quality is secured.

For example, when assembling the printer 1 for the first time, an operator who assembles the printer 1 can perform height adjustment of the first end portion 28 and the second end portion 29 of the carriage 20 by rotating the rotating shaft portion 244 by the predetermined amount. Further, even when the nozzle cap 33 of the purge unit 30 is replaced, by performing the height adjustment of the first end portion 28 and the second end portion 29 of the carriage 20, the operator can adjust the distance between the nozzle cap 33 and the ejection surface of each of the head portions 105 and 205 to be uniform so that the ejection surface of each of the head portions 105 and 205 is parallel to the nozzle cap 33. Therefore, the nozzle cap 33 can cover the ejection surface of each of the head portions 105 and 205 while maintaining the sealing performance. The amount of eccentricity of the central axis Q with respect to the central axis P is not limited to the example of the present embodiment, and may be changed as appropriate in accordance with the tolerances etc. that occur on the first end portion 28 side and the second end portion 29 side of the carriage 20.

As shown in FIG. 12, the eccentric member 243 is disposed on the second end portion 29 of the carriage 20, between the left-side pressing portion 22 and the right-side pressing portion 23. The pressing force by which the contact portion 221 of the left-side pressing portion 22 and the contact portion 231 of the right-side pressing portion 23 press the front surface 73 of the rail 7 rearward generates a reaction force by which the front surface 73 presses the contact portions 221 and 231 forward. The reaction force is transmitted to the carriage 20 via the arm portions 223 and 233, and acts in a direction in which the carriage 20 is pressed against the guide shaft 9 that is disposed to the front. The first end portion 28 of the carriage 20 is supported by the guide shaft 9 being inserted through the support portions 21L and 21R. On the second end portion 29 of the carriage 20, the left-side pressing portion 22, the right-side pressing portion 23, the lower-side pressing portion 25 and the regulating portion 24 are in contact with the rail 7. With the above-described structure, slight rattling that occurs in the carriage 20 and inclination in the left-right direction that is caused by acceleration of the carriage 20 are more likely to be generated on the second end portion 29 of the carriage 20 than on the first end portion 28 of the carriage 20. In the present embodiment, the left-side pressing portion 22 and the right-side pressing portion 23 are provided, respectively, on both the ends in the second direction of the second end portion 29 such that the eccentric member 243 is disposed therebetween. With the above-described structure, the support portions 21L and 21R are pressed toward the center of the guide shaft 9 and the rattle of the carriage 20 and the inclination in the left-right direction are suppressed. Therefore, in the printer 1, the distances between the nozzle caps 33 and the first end portion 28 side and the second end portion 29 side are maintained more uniformly, and it is possible to further improve the sealing performance between the nozzle caps 33 and the ejection surfaces of the respective head portions 105 and 205.

Figure 14:
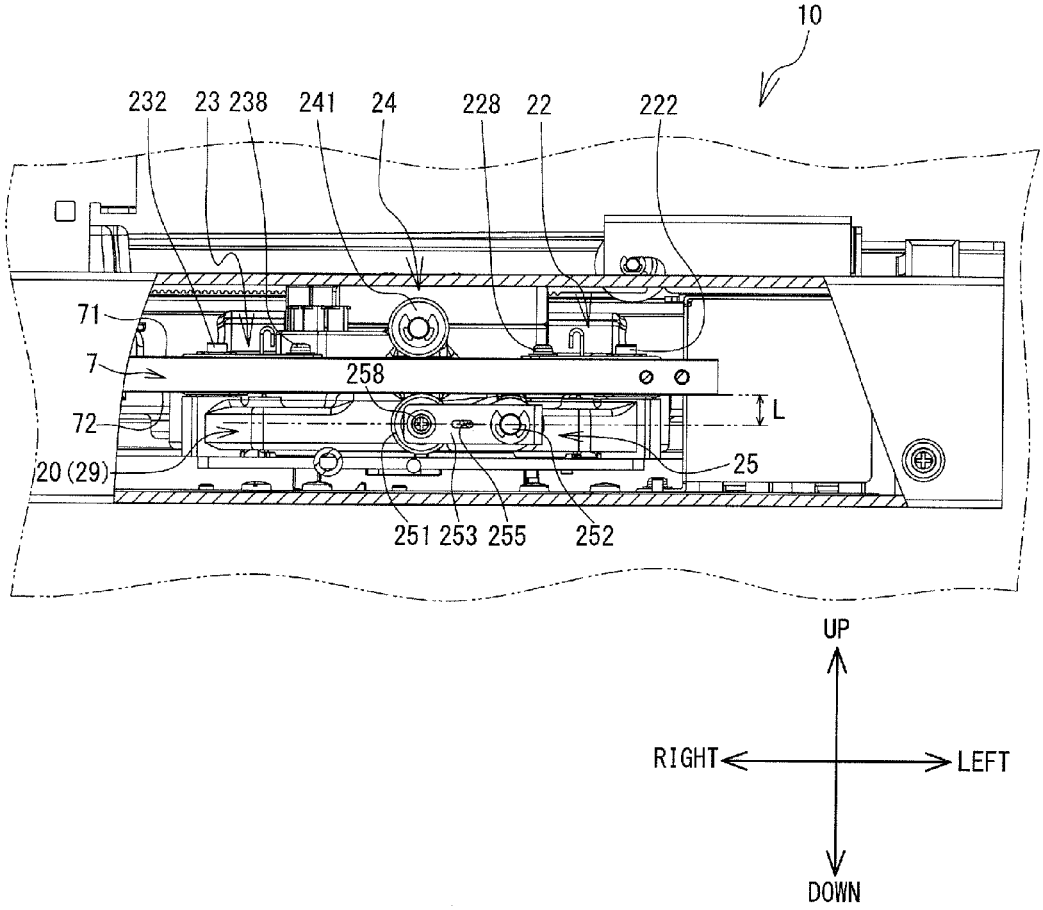
FIG. 14 is an enlarged cross-sectional view of the frame body 10 when viewed from the rear side.

The arrangement of the lower-side pressing portion 25 and the rail 7 will be explained in detail with reference to FIG. 14. As shown in FIG. 14, the distance in the up-down direction between the position of a central axis of the support member 258 and the lower surface 72 of the rail 7 is referred to as a distance L. In the support member 258, the arm portion 253 supports the contact portion 251. In the present embodiment, the distance from the position of a central axis of the support shaft 252 to the lower surface 72 is equal to the distance L. It is preferable that the distance from the position of the central axis of the support shaft 252 to the lower surface 72 is within the distance L. In other words, it is preferable that the position of the central axis of the support shaft 252 is arranged between the lower surface 72 and the support member 258 that is located in a position where the arm portion 253 supports the contact portion 251.

The contact portion 251 is pressed against the lower surface 72 by the arm portion 253, and is slightly elastically deformed. When the distance from the central axis of the support shaft 252 to the lower surface 72 is longer than the distance L, a restoring force that restores the elastically deformed contact portion 251 tends to act in a direction to inhibit the carriage 20 from moving rightward. When the carriage 20 moves further rightward in the above-described state, it is easy for the contact portion 251 to become sandwiched between the arm portion 253 and the lower surface 72 and a load tends to occur when the carriage 20 moves rightward. On the other hand, when the carriage 20 moves leftward, in accordance with the rotation of the contact portion 251, the restoring force of the elastically deformed contact portion 251 acts in a direction in which an end portion on the side where the support member 228 of the arm portion 253 is provided is separated from the lower surface 72 centered on the support shaft 252. Therefore, when the carriage 20 moves leftward, it is more likely to generate a load on the carriage 20 than in a case in which the carriage 20 moves rightward. In a state in which there is a bias in the load on the carriage 20 in accordance with the movement direction, it is difficult for the printer 1 to maintain a movement speed of the carriage 20 to be constant. In order to secure the printing quality of the printer 1, it is preferable to maintain the movement speed of the carriage 20 to be constant regardless of whether the carriage 20 moves rightward or leftward.

When the distance from the central axis of the support shaft 252 to the lower surface 72 is equal to the distance L, the problem of the contact portion 251 becoming sandwiched between the arm portion 253 and the lower surface 72 is unlikely to occur. Further, when the distance from the central axis of the support shaft 252 to the lower surface 72 is shorter than the distance L, regardless of whether the carriage 20 moves leftward or rightward, the restoring force of the elastically deformed contact portion 251 tends to act in the direction in which the end portion on the side where the support member 228 of the arm portion 253 is provided is separated from the lower surface 72 centered on the support shaft 252. More specifically, when the distance from the central axis of the support shaft 252 to the lower surface 72 is within the distance L, a bias is unlikely to occur in the load on the carriage 20 in accordance with the movement direction. Therefore, in the printer 1, it is possible to reliably maintain the movement speed of the carriage 20 to be constant.

As explained above, in the printer 1, the first end portion 28 side of the carriage 20 is supported by the guide shaft 9. Further, the lower-side pressing portion 25 that is provided on the second end portion 29 side of the carriage 20 presses the lower surface 72 of the rail 7 upward. Further, the regulating portion 24 comes into contact with the upper surface 71 of the rail 7 from above. The lower-side pressing portion 25 and the regulating portion 24 that are arranged facing each other in the up-down direction clamp the rail 7 in the up-down direction, and thus determine the height of the second end portion 29. The regulating portion 24 is provided with the eccentric member 243. The eccentric member 243 is provided with the rotating shaft portion 244 and the eccentric shaft portion 245. The rotating shaft portion 244 is axially supported by the fixed portion 242 and has the central axis P that extends in the first direction. The eccentric shaft portion 245 has the central axis Q that is eccentric with respect to the central axis P. In the present embodiment, the number of the components that are disposed on the second end portion 29 side of the carriage 20 is larger than the number of the components that are disposed on the first end portion 28 side. Therefore, the tolerances that are accumulated on the second end portion 29 side tend to be larger than the tolerances that are accumulated on the first end portion 28 side. Also in the above-described case, in the printer 1, the rotating shaft portion 244 of the eccentric member 243 rotates, and in accordance with the eccentric amount of the central axis Q of the eccentric shaft portion 245 with respect to the central axis P of the rotating shaft portion 244, it is possible to adjust the position (height) in the up-down direction of the contact portion 241 that is supported by the eccentric shaft portion 245. The prohibition portion 249 fixes the eccentric member 243 to the fixed portion 242 and prohibits the eccentric member 243 from rotating. It is thus possible to maintain the adjusted height of the contact portion 241. Therefore, in the printer 1, by adjusting the height of the contact portion 241, it is possible to suppress a change in the distance between the nozzle caps 33 and the head portions 105 and 205. Therefore, in the printer 1, in a state in which the carriage 20 is at the origin position, it is possible to improve the sealing performance between the nozzle caps 33 and the ejection surfaces of the respective head portions 105 and 205.

The contact portion 251 of the lower-side pressing portion 25 is caused to come into contact with the lower surface 72 of the rail 7 by the urging force of the coil spring 254 that urges the arm portion 253. In other words, the second end portion 29 is reliably supported in the up-down direction with respect to the rail 7 by the contact portion 251 of the lower-side pressing portion 25 and the contact portion 241 of the regulating portion 24. Therefore, in the printer 1, the height of the adjusted contact portion 241 is maintained, and it is possible to suppress a change in the distance between the nozzle caps 33 and the head portions 105 and 205

When the position of the central axis of the support shaft 252 of the lower-side pressing portion 25 is not arranged between the lower surface 72 and the support member 258 that is in the position where the arm portion 253 supports the contact portion 251, a load tends to occur when the carriage 20 moves rightward. In the above-described case, it is difficult to maintain the speed of the reciprocating movement of the carriage 20 to be constant, and this may affect the printing quality of the printer 1. In the printer 1, the position of the central axis of the support shaft 252 is arranged between the lower surface 72 and the support member 258 that is in the position where the arm portion 253 supports the contact portion 251, and it is thus possible to inhibit the printing quality from deteriorating.

The left-side pressing portion 22 and the right-side pressing portion 23 are respectively arranged on the left end and the right end of the second end portion 29 such that the eccentric member 243 is disposed therebetween on the second end portion 29. The pressing force by which the contact portion 221 of the left-side pressing portion 22 and the contact portion 231 of the right-side pressing portion 23 press the front surface 73 rearward generates a reaction force by which the front surface 73 presses the contact portions 221 and 231 forward. The reaction force is transmitted to the carriage 20 via the arm portions 223 and 233, and acts in a direction in which the carriage 20 is pressed against the guide shaft 9 that is disposed to the front. Therefore, in the printer 1, the rattling of the carriage 20 with respect to the guide shaft 9 is suppressed, and the change in the distance between the nozzle caps 33 and the head portions 105 and 205 is suppressed. It is thus possible to further improve the adherence of the nozzle caps 33 with respect to the ejection surfaces of the respective head portions 105 and 205.

The first end portion 28 side of the carriage 20 is configured to be supported by the guide shaft 9 being inserted. Therefore, the first end portion 28 side is more unlikely to be affected by the tolerances than the second end portion 29 side. The head unit 100, which ejects the color inks for post-treatment to draw a pattern etc. after the head unit 200 ejects the white ink for pre-treatment, is required to eject the inks at a higher accuracy than the head unit 200. In the carriage 20, the head unit 100 is disposed on the first end portion 28 side that is unlikely to be affected by the tolerances. Therefore, in the printer 1, particularly, the nozzle cap 33 is caused to reliably come into contact with the head portion 105 of the head unit 100, and it is thus possible to secure the sealing performance between the head portion 105 and the nozzle cap 33.

Note that the present disclosure is not limited to the above-described embodiment, and various modifications are possible. For example, it is sufficient if the head unit 100 and the head unit 200 are arranged side by side in the front-rear direction. In the printer 1, the two head units 100 and 200 need not necessarily be arranged in series accurately in the front-rear direction. For example, in the printer 1, the positions of the head unit 100 and the head unit 200 may be mutually displaced in the left-right direction (a so-called zigzag alignment) within a range in which the pre-treatment printing and the post-treatment printing can be performed in the same process. Further, the interior of each of the head portions 105 and 205 is divided into the four sections along the left-right direction, corresponding to the respective color inks. However, the number of the sections may be changed as appropriate.

In the above-described embodiment, the contact portion 251 of the lower-side pressing portion 25 has a cylindrical shape. The contact portion 251 is not limited to the cylindrical shape, and it is sufficient if the contact portion 251 has a shape that can come into contact with the lower surface 72 of the rail 7. Further, the contact portion 251 need not necessarily be supported such that it is rotatable with respect to the arm portion 253. The contact portion 251 may be fixed to an end portion of the arm portion 253 by the support member 228 such that the contact portion 251 does not rotate.

The liquid that is supplied to the head units 100 and 200 is not limited to the above-described inks, and may be ink of another color, such as gold, silver or the like. Further, the liquid that is supplied to the head units 100 and 200 is not limited to the inks of the present embodiment. For example, a treating agent to improve ink fixing may be used instead of the pre-treatment ink, and a color ink may be used as a post-treatment liquid. For example, in discharge printing, a discharging agent may be used instead of the pre-treatment ink, and a discharge ink may be used instead of the post-treatment ink. In other words, it is sufficient if the liquid that can be ejected by the head units 100 and 200 is a liquid having characteristics, such as viscosity etc., that allow ejection from the head units 100 and 200. Therefore, the liquid is not limited to ink, and may be a chemical agent, such as a decoloring agent, for example. Further, the pre-treatment liquid and the post-treatment liquid may be the same type of liquid.

What is claimed is:

1. A printer comprising:

a feeding portion that is configured to feed a print medium in a first direction;

an ejection portion that is configured to eject liquid toward the print medium;

a carriage on which the ejection portion is mounted and which is configured to reciprocate in a second direction, the second direction being a direction that is orthogonal to the first direction;

a guide shaft that extends in the second direction and that supports a first end portion of the carriage in the first direction;

a rail member that extends in the second direction and that is disposed facing the guide shaft;

a cap that covers the ejection portion from a first side, the first side being a direction toward which the ejection portion ejects the liquid;

a first pressing portion that is provided on a second end portion of the carriage and that presses a first surface, which is a surface on the first side of the rail member, the second end portion of the carriage being an end portion on an opposite side to the first end portion of the carriage in the first direction;

an eccentric member that has a rotating shaft portion and an eccentric shaft portion, the rotating shaft portion being axially supported by the second end portion of the carriage and extending in the first direction, and the eccentric shaft portion being eccentric with respect to the rotating shaft portion;

a regulating portion that is supported by the eccentric shaft portion and that is disposed on a second side of the first pressing portion such that the regulating portion faces the first pressing portion with the rail member interposed between the regulating portion and the first pressing portion, the regulating portion coming into contact with a second surface of the rail member and regulating movement of the carriage to the first side, the second side of the first pressing portion being an opposite side to the first side of the first pressing portion, and the second surface of the rail member being a surface on the second side of the rail member; and a prohibition portion that fixes the rotating shaft portion and that prohibits rotation of the rotating shaft portion.

2. The printer according to claim 1, wherein the first pressing portion includes a contact portion that comes into contact with the first surface of the rail member, a support shaft that extends along the first direction, an arm member that is provided swingably around the support shaft and that supports the contact portion at an end portion on an opposite side to the support shaft, and an urging member that urges the arm member in a direction in which the contact portion comes into contact with the first surface of the rail member.

3. The printer according to claim 2, wherein a position of a central axis of the support shaft is arranged between a position at which the arm member supports the contact portion and the first surface of the rail member.

4. The printer according to claim 1, further comprising:

two pressing portions that are provided on the second end portion of the carriage and that press a third surface of the rail member, the third surface of the rail member being a surface of the rail member on a side that faces the guide shaft, wherein the eccentric member is disposed between the two pressing portions.

5. The printer according to claim 1, wherein a plurality of the ejection portions are mounted on the carriage such that the plurality of ejection portions are arranged side by side in the first direction, the plurality of ejection portions include a pre-treatment ejection portion that ejects a pre-treatment liquid onto the print medium, and a post-treatment ejection portion that ejects a post-treatment liquid onto the print medium after the pre-treatment liquid has been ejected by the pre-treatment ejection portion, and the post-treatment ejection portion is disposed on the first end portion side of the carriage with respect to the pre-treatment ejection portion.

6. The printer according to claim 1, wherein the regulating portion is provided with a fixed portion, the fixed portion standing at a center of the second end portion of the carriage, extending toward the second side, and fixing the rotating shaft portion to an inner portion of the fixed portion, a central axis of the rotating shaft portion extends in the first direction in the inner portion of the fixed portion, and the prohibition portion is a screw member and fixes the rotating shaft portion to the fixed portion from the second side.

* * * * *